US006904965B2

(12) United States Patent
Beck et al.

(10) Patent No.: US 6,904,965 B2
(45) Date of Patent: Jun. 14, 2005

(54) RADIATOR WITH SIDE FLAT TUBES

(75) Inventors: Ralf Beck, Reutlingen (DE); Werner Nitsche, Teck (DE); Jörg Soldner, Ehingen (DE)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 10/658,972

(22) Filed: Sep. 10, 2003

(65) Prior Publication Data

US 2004/0112577 A1 Jun. 17, 2004

(30) Foreign Application Priority Data

Sep. 12, 2002 (DE) ..... 102 42 311

(51) Int. Cl.[7] ..... F28F 9/02

(52) U.S. Cl. ..... 165/175; 165/153; 165/174; 165/176

(58) Field of Search ..... 165/148–153, 165/172–176, 146

(56) References Cited

U.S. PATENT DOCUMENTS 3,034,770 A * 5/1962 Hiersch ..... 165/103
4,098,328 A * 7/1978 Cheong ..... 165/72
4,771,942 A * 9/1988 Arold et al. ..... 237/12.3 B
4,791,982 A * 12/1988 Meyerhofer ..... 165/282
5,101,890 A * 4/1992 Aoki et al. ..... 165/152
5,186,248 A * 2/1993 Halstead ..... 165/173
5,236,042 A * 8/1993 Kado ..... 165/149
5,697,433 A * 12/1997 Kato ..... 165/170
6,341,648 B1 * 1/2002 Fukuoka et al. ..... 165/144

* cited by examiner

*Primary Examiner*—Tho v Duong
(74) *Attorney, Agent, or Firm*—Wood, Phillips, Katz, Clark & Mortimer

(57) ABSTRACT

A vehicle radiator including inlet and outlet headers, a soldered core having a plurality of coolant flat tubes joining the inlet header and the outlet header with cooling fins on opposite sides of the coolant flat tubes, and a multifunction flat tube on at least one side of the core. The multifunction flat tube has a greater section modulus than the coolant flat tubes, and is soldered to adjacent cooling fins and the inlet and outlet headers whereby the multifunction flat tube carries coolant from the inlet header to the outlet header. The multifunction flat tubes each also have an inner flow resistance which is substantially smaller than the inner flow resistance of individual coolant flat tubes whereby more coolant flows through each multifunction flat tube than flows through an individual coolant flat tube per unit time.

18 Claims, 5 Drawing Sheets

RADIATOR WITH SIDE FLAT TUBES

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to heat exchangers, and more specifically to radiators having a core formed of flat tubes and cooling fins.

BACKGROUND OF THE INVENTION AND TECHNICAL PROBLEMS POSED BY THE PRIOR ART

Heat exchangers such as radiators having one or more rows of flat tubes with cooling fins forming a core between two collecting tanks or headers are known, for example, from EP 693 617 B1 or DE 43 28 448 C2. Radiators are so-called cross-flow radiators, and are often used in passenger cars. Such radiators generally have soldered tubes and fins in the core, with the core commonly having side plates on opposite sides between the headers (i.e., with the side plates extending parallel to the longitudinal axis of the flat tubes). In aluminum cores, the side plates are generally also made from an aluminum sheet, which sheet may be variously deformed depending upon the design, and are generally soldered to the cooling fins on the outer sides of the core (i.e., the fins on the outer side of the end flat tubes). Such side plates not only protect the fins on the outer side, but reinforce the radiator by adding strength, and assist in mounting the radiator as desired (e.g., in a vehicle). Of course, the side plates also have an effect on the manufacturing cost of the radiator, and on the weight of the radiator.

Radiators are also known in which at least one lower or upper separated tube of a core functions as a vent tube or intake tube. However, such separated tubes are not fully available at least for operational heat exchange. DE 43 28 448 has proposed a core structure having a connection line lying on the bottom which includes part of the flat tubes of the core, where filling of the circuit is produced via this connection line. However, a check valve is required in that proposed core structure in order to separate the collecting tank on the pressure side from the collecting tank on the intake side to achieve uniform flow through all the flat tubes during operation.

In heavy vehicles and utility vehicles, a separately positioned hose line or the like is generally used to fill the cooling loop, with the hose line connected to the equalization vessel incorporated in the cooling loop.

The present invention is directed toward improving upon the above types of radiators.

SUMMARY OF THE INVENTION

In one aspect of the present invention, a vehicle radiator is provided including inlet and outlet headers, a soldered core having a plurality of coolant flat tubes joining the inlet header and the outlet header with cooling fins on opposite sides of the coolant flat tubes, and a multifunction flat tube on at least one side of the core. The multifunction flat tube has a greater section modulus than the coolant flat tubes, and is soldered to adjacent cooling fins and the inlet and outlet headers whereby the multifunction flat tube carries coolant from the inlet header to the outlet header.

In one form of this aspect of the invention, a second multifunction flat tube is provided on the opposite side of the core and soldered to adjacent cooling fins and the inlet and outlet headers, the second multifunction flat tube also having a greater section modulus than the coolant flat tubes.

In another form of this aspect of the invention, the radiator is a downdraft radiator with the inlet header on top and the outlet header on the bottom, and the inlet and outlet headers include openings receiving ends of the coolant and multifunction flat tubes. The opening receiving an end of the multifunction flat tube is larger than each of the plurality of openings receiving the coolant flat tubes.

In still another form of this aspect of the invention, the multifunction flat tube has substantially the same length "h" and depth "t" as the core.

In yet another form of this aspect of the invention, the multifunction flat tube is formed by one of soldering and welding.

In a further form of this aspect of the invention, the multifunction flat tube includes walls extending the depth of the core, and the tube walls are deformed along their length between the inlet and outlet headers to define separate coolant passages.

In still another form of this aspect of the invention, the multifunction flat tube includes flat walls extending the depth of the core, and an insert is provided between the flat walls of the multifunction flat tube whereby the insert defines coolant passages through the multifunction flat tube between the inlet and outlet headers.

In yet another form of this aspect of the invention, the multifunction flat tube includes flat walls extending the depth of the core with inward directed protrusions, the protrusions being connected to each other.

In a further form of this aspect of the invention, the inner flow resistance of the multifunction flat tube is substantially smaller than the inner flow resistance of the coolant flat tubes.

In still another form of this aspect of the invention, the multifunction flat tube has a wall thickness substantially greater than the wall thickness of the coolant flat tubes and a tube height substantially greater than the height of the coolant flat tubes. In one advantageous form, the multifunction flat tube wall thickness is at least two times the wall thickness of the coolant flat tubes, with the multifunction flat tube wall thickness being at least about 1.0 mm in a further form. In another advantageous form, the height of the multifunction flat tube is at least two times the height of the coolant flat tubes, with the multifunction flat tube being at least about 10 mm in a further form.

In yet another form of this aspect of the invention, the flat tubes extend generally vertically with the inlet header soldered to the upper ends of the flat tubes, and the radiator further includes a partition in the inlet header defining first and second chambers, the first chamber being above the multifunction flat tube and the second chamber being above the coolant flat tubes, and also includes a filling line between a coolant fill supply and the first chamber for adding coolant to the radiator. In a further form, the filling line slopes down from the coolant fill supply to the first chamber.

In another aspect of the present invention, a vehicle radiator is provided including inlet and outlet headers, a soldered core having a plurality of coolant flat tubes joining the inlet header and the outlet header with cooling fins on opposite sides of the coolant flat tubes, and a multifunction flat tube on at least one side of the core. The multifunction flat tube is soldered to adjacent cooling fins and the inlet and outlet headers whereby the multifunction flat tube carries coolant from the inlet header to the outlet header, and has an inner flow resistance which is substantially smaller than the inner flow resistance of the coolant flat tubes whereby more coolant flows through the multifunction flat tube than flows through an individual coolant flat tube per unit time to influence temperature distribution over the entire radiator.

In one form of this aspect of the invention, a second multifunction flat tube is provided on the opposite side of the core and soldered to adjacent cooling fins and the inlet and outlet headers. The second multifunction flat tube also has an inner flow resistance which is substantially smaller than the inner flow resistance of the coolant flat tubes whereby more coolant flows through the second multifunction flat tube than flows through an individual coolant flat tube per unit time to influence temperature distribution over the entire radiator.

In another form of this aspect of the invention, the radiator is a downdraft radiator with the inlet header on top and the outlet header on the bottom, and the inlet and outlet headers include openings receiving ends of the coolant and multifunction flat tubes. The opening receiving an end of the multifunction flat tube is larger than each of the plurality of openings receiving the coolant flat tubes.

BRIEF DESCRIPTION OF THE DRAWINGS

The invention is described in practical examples below. Reference is made to the accompanying drawing for this purpose.

In the drawings.

DETAILED DESCRIPTION OF THE INVENTION

Figure 1:
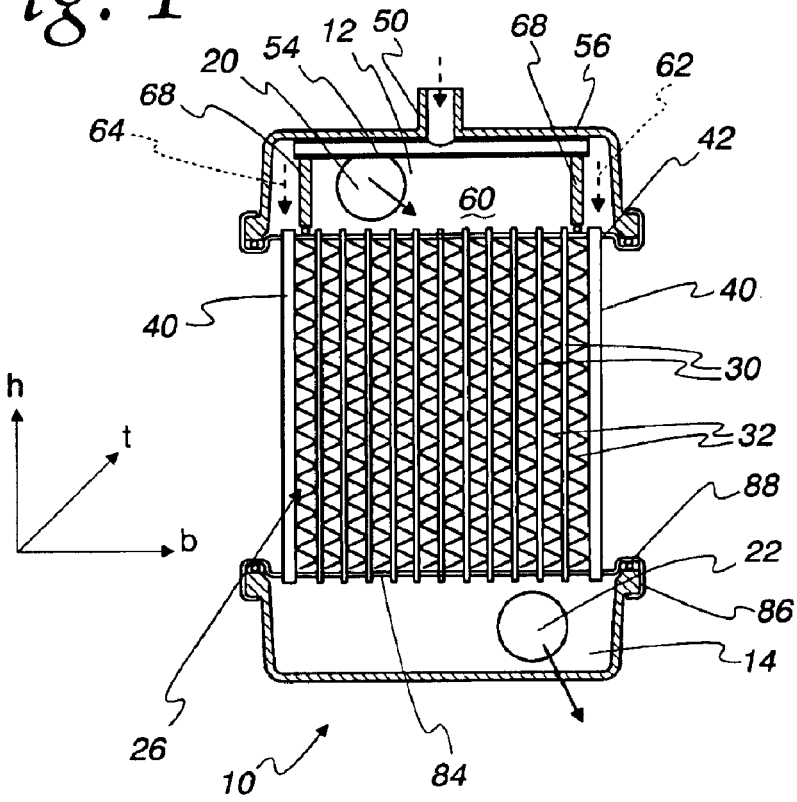
FIG. 1 is a face view of a first embodiment of a radiator incorporating the present invention, with the headers shown in cross-section.

A radiator 10 incorporating elements of the present invention is shown in FIG. 1. The illustrated radiator 10 may be used, for example, in heavy vehicles in order to cool the cooling liquid of the internal combustion engine, and is a so-called downdraft radiator in which the inlet collecting tank or header 12 is arranged on the top and the outlet collecting tank or header 14 on the bottom. The inlet header 12 has an inlet connector 20 and the outlet header 14 has a corresponding outlet connector 22 with which the radiator 10 together with an equalization vessel (not shown) and other corresponding elements may be incorporated in a cooling loop (not shown).

The radiator 10 includes a soldered core 26, of a type which is generally known, including alternating arranged coolant flat tubes 30 and cooling ribs or fins 32. In the illustrated radiator 10, the flat tubes 30 may have a height (i.e., minor dimension between the fins 32 on opposite sides of the tubes 30) of only about 1.8 mm, and without inserts therein. Also, in the illustrated radiator 10, the fins 32 are serpentine.

In accordance with the present invention, multifunction flat tubes 40 are provided on opposite sides of the core 26, soldered to the fins 32 on the outer side of the last coolant flat tubes 30 to thereby provide for good heat transfer.

In accordance with the present invention, the multifunction flat tubes 40 also provide a rigid side to the core 26 to prevent outward expansion or bulging of the core 26, whereby the side plates such as used with prior cores of this type may be omitted. The multifunction flat tubes 40 have a significantly higher section modulus Wx, Wy (see FIG. 7*b*) than do the prior art side plates. As a result, the multifunction flat tubes 40 can be produced with walls formed of a significantly thinner sheet than such prior art side plates, without increasing the weight of the core 26 or reducing the stability of the core 26, while still providing the required strength desired for suitable core stability.

The section modulus Wx, Wy of the multifunction flat tubes 40 is also significantly greater than the section modulus of individual coolant flat tubes 30. Specifically, the multifunction flat tubes 40 are made from a sheet having a greater thickness "b" (see FIG. 7*b*), and have a significantly greater height "d", than the coolant flat tubes 30. For example, the multifunction flat tube 40 may have a height "d" on the order of 10 mm, but in any case should have a height which is at least twice the height of the coolant flat tubes 30 (e.g., where the tubes 30 have a height of about 1.8 mm as previously indicated, the multifunction flat tubes 40 would have a height "d" of at least about 3.6 mm). The walls of the multifunction flat tubes 40 may similarly be advantageously formed with sheets having a thickness "b" which is significantly greater than the thickness of the walls of the coolant flat tubes 30 (e.g., a sheet thickness of about 1.0 mm for the multifunction flat tubes 40 versus a sheet thickness of about 0.1–0.4 mm for the coolant flat tubes 30).

The multifunction flat tubes 40 have generally the same depth "t" (see FIG. 7*d*) and same length "h" (see axis "h" in FIG. 1) as the coolant flat tubes 30, so as to generally extend over the full sides of the core 26. Where a core is formed having multiple tube rows, however, the depth "t" of the multifunction flat tubes would be correspondingly greater than the depth of the tubes given the greater core depth (i.e., the depth "t" would be the depth of the coolant flat tubes times the number of tubes plus the spacing between the tube rows).

Like the coolant flat tubes 30, the multifunction flat tubes 40 are suitably connected to the inlet and outlet headers 12, 14 on their ends 42 so as to provide coolant flow paths between the headers 12, 14.

Figure 3:
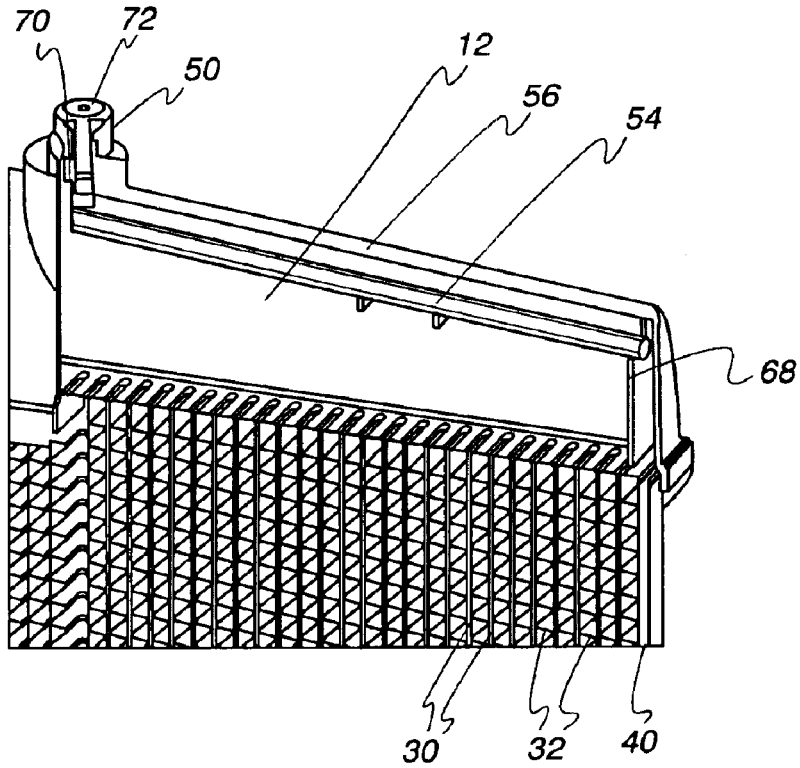
FIG. 3 is a partial longitudinal section through a radiator in accordance with the FIG. 1 embodiment, where only about half of the inlet header is shown.

Referring now specifically to the embodiment shown in FIGS. 1 and 3, a filling opening 50 is provided on the inlet header 12, with the fill opening 50 connected to a supply of coolant and open to a filling line 54 suitably secured to the inside of a wall 56 of the inlet header 12. The filling line 54 is sloped downward from the fill opening 50 toward the sides of the inlet header 12, which is divided into a middle or central chamber 60 and two side chambers 62, 64 by generally vertical partitions 68 positioned between the multifunction flat tubes 40 and the adjacent, outermost coolant flat tubes 30. Thus, the filling line 54 leads from the fill opening 50 to the two side chambers 62, 64.

As described in greater detail in FIGS. 5*a*–7*b* below, the multifunction flat tube 40 may advantageously be configured in a number of different ways whereby its inner flow resistance ensures circulation therethrough in a suitable period of time. Specifically, the multifunction flat tubes 40 may be advantageously configured to ensure that a filling function is provided whereby the requisite cooling liquid to be filled can be introduced into the cooling loop in an acceptable time. Filling may occur through a suitable equalization vessel connected to the fill opening 50. In a compact design, the equalization vessel may be situated directly on the inlet header 12. Air escaping upward during filling of the cooling loop passes through a radiator vent 70 integrated in the cover 72 of the fill opening 50 (see FIG. 3).

Moreover, since the multifunction flat tubes 40 are continuously traversed by coolant during operation and therefore participates in heat exchange, the particular multifunction flat tube design chosen may advantageously seek an optimum between providing a short fill time and providing the highest possible heat exchange rate of the multifunction flat tubes 40. During cooling operation, a portion of the coolant continuously flows from the equalization vessel through the filling line 54 into the side chambers 62, 64 and through the multifunction flat tubes 40 so that these can make a contribution to cooling of the coolant, in which the heat is taken off via the cooling fins 32 traversed by cooling air. Specifically, with cores of this type according to the prior art, the temperature distribution ordinarily has a parabolic trend over the width of the radiator, with the maximum temperature line roughly in the center of the core and the outer lying flat tubes generally poorly traversed and hardly participating at all in heat exchange. In accordance with the present invention, the multifunction flat tubes 40 contribute to deliberate equalization of the temperature over the entire radiator 10.

Figure 2:
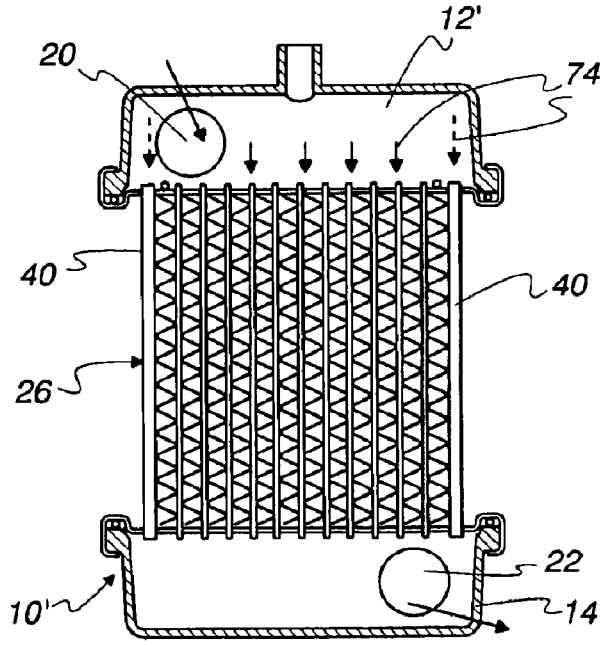
FIG. 2 is a view similar to FIG. 1, showing a second embodiment according to the present invention in which the filling function is not provided.

FIG. 2 illustrates a second embodiment of an advantageous radiator 10' in accordance with the present invention. In the illustration, components essentially the same as components as in FIG. 1 are given the same reference numerals, and similar but modified components are given the same reference number with a prime added.

With the FIG. 2 embodiment, the inlet header 12' has a single chamber open to all of the flat tubes 30, 40, whereby a separate filling function is not provided. Nonetheless, advantageous equalization of temperature distribution over the entire radiator 10' in accordance with the present invention is achieved, as is the provision of a stable core 26. Further, while the side plates of the prior art may advantageously be omitted in accordance with the present invention, cooling equalization may nonetheless be provided even with such side plates. Specifically, given the greater cross-sectional size of, and lower flow resistance through, the multifunction flat tubes 40 as compared to the coolant flat tubes 30, a larger stream flows through the multifunction flat tube 40 than through each individual coolant flat tube 30 as indicated by the arrows 74 marked in the inlet header 12' in FIG. 2.

It should also be understood that the inner flow resistance in both multifunction flat tubes 40 do not necessarily need to be equally large, and it would be within the scope of the present invention, and even advantageous in certain designs, to provide unequal flow resistance in the multifunction flat tubes 40 so that the flow amounts in the two multifunction flat tubes 40 may be different. Moreover, provision of only one multifunction flat tube on one side of the core may also advantageously benefit from the present invention in certain designs.

It should thus be appreciated that multifunction flat tubes 40 such as described above may be used not only to improve performance, but may also be used to reduce temperature differences across the core which can lead to stress cracking.

Figure 4:
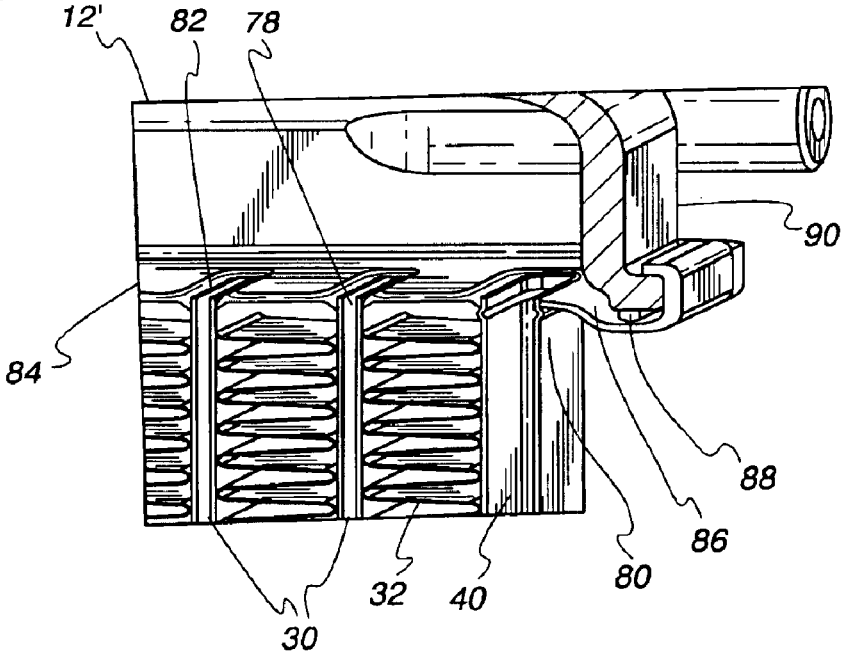
FIG. 4 is a partial longitudinal section through a radiator in accordance with the FIG. 2 embodiment.

FIG. 4 illustrates one suitable connection between the flat tubes 30, 40 and the headers 12, 14. Specifically, openings 78 are present in the tube ends 80 which are received in collars 82 in the header plate 84 (whereby the plate 84 defines the tube ends of the core). The collars 82 are tapered toward the core. This connection provides a high quality, leak proof solder connection between the flat tubes 30, 40 and heater plate 84. It should be understood, however, that still other connections between the flat tubes 30, 40 and the headers 12, 14 could also be advantageously used in connection with the present invention.

The header plate 84 may include a continuous groove 86 with a seal 88 arranged in the groove 86, whereby the headers 12, 14 may be formed by firmly and tightly mechanically joining the edge of the header plate 84 to the edge a plastic housing 90 (see FIG. 4). As with the FIG. 2 embodiment, no filling function is provided in the inlet header 12' illustrated in FIG. 4

Figure 5A:
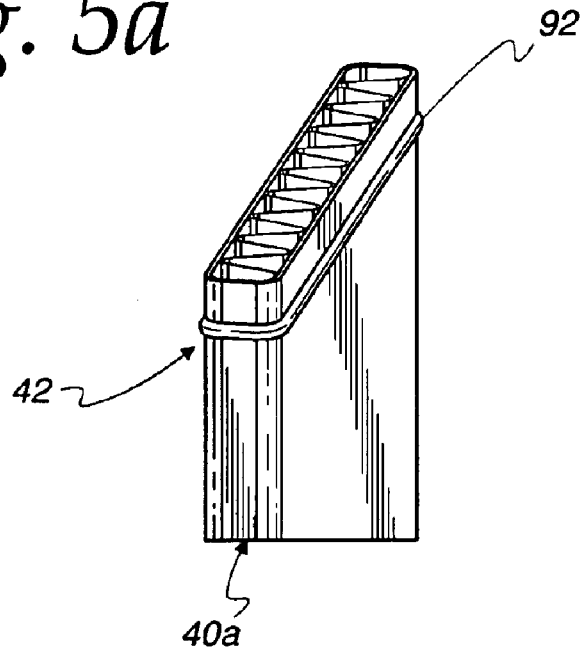
FIGS. 5*a–c* illustrate an end of one multifunction flat tube which may be used in accordance with the present invention.
Figure 5B:
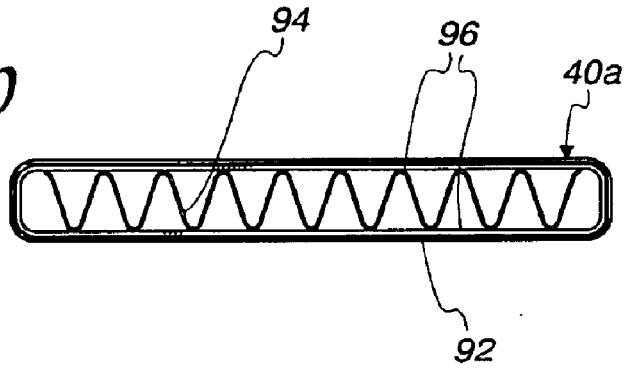
Figure 5C:
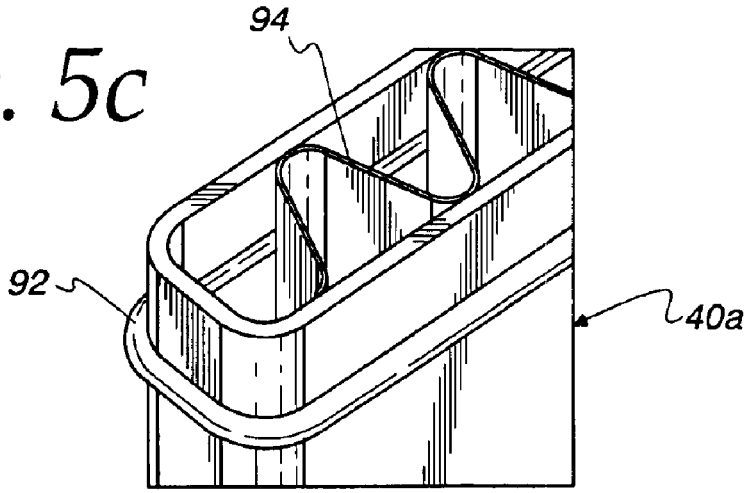

FIGS. 5*a*–*c* disclose one embodiment of a multifunction flat tube 40*a* which may be advantageously used with the present invention. The multifunction flat tube 40*a* advantageously has a bead 92 or similar deformation on its ends 42. This bead 92 serves as a stop of the multifunction flat tube 40*a* during assembly of the core (i.e., during assembly of the flat tubes 30, 40 the fins 32 with the header plates 84, which are assembled before performing the soldering process). A suitable insert 94 may also be provided in the multifunction flat tube 40*a*, with the insert 94 suitably secured therein (as by soldering to the long side walls of the tube 40*a*) to further enhance the stability of the multifunction flat tubes 40*a* (and thereby the stability of the core 26) as well as providing coolant flow passages providing enhanced heat transfer with the coolant flowing through such tubes 40*a*.

Figure 6A:
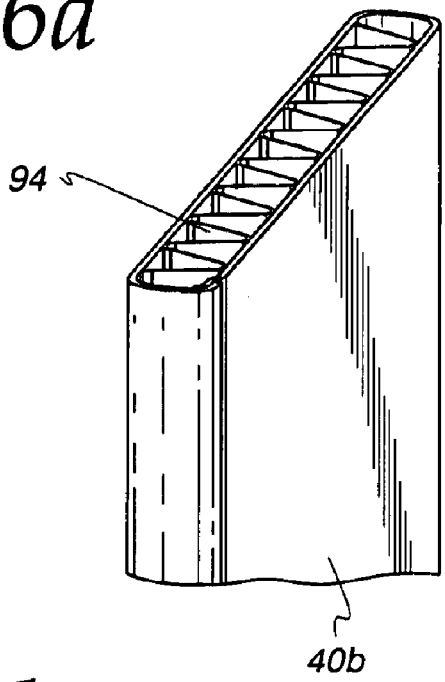
FIGS. 6*a–c* illustrate an end of another multifunction flat tube which may be used in accordance with the present invention.
Figure 6B:
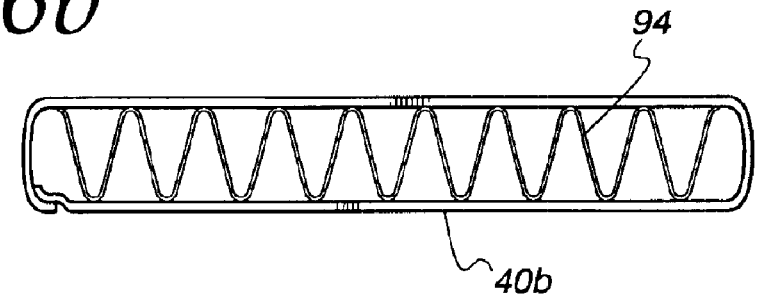
Figure 6C:
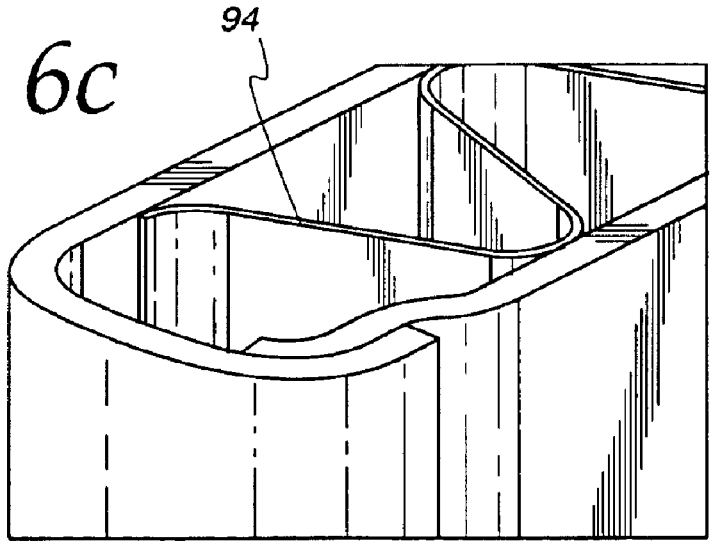

FIGS. 6*a*–*c* illustrate another multifunction flat tube 40*b* which may be advantageously used with the present invention. The tube 40*b* may be formed of a bent sheet of material suitably sealed, as by soldering or welding, along a longitudinal joint. As illustrated, the tube 40*b* also includes an insert 94 such as shown in the embodiment of FIGS. 5*a*–*c*.

Figure 7A:
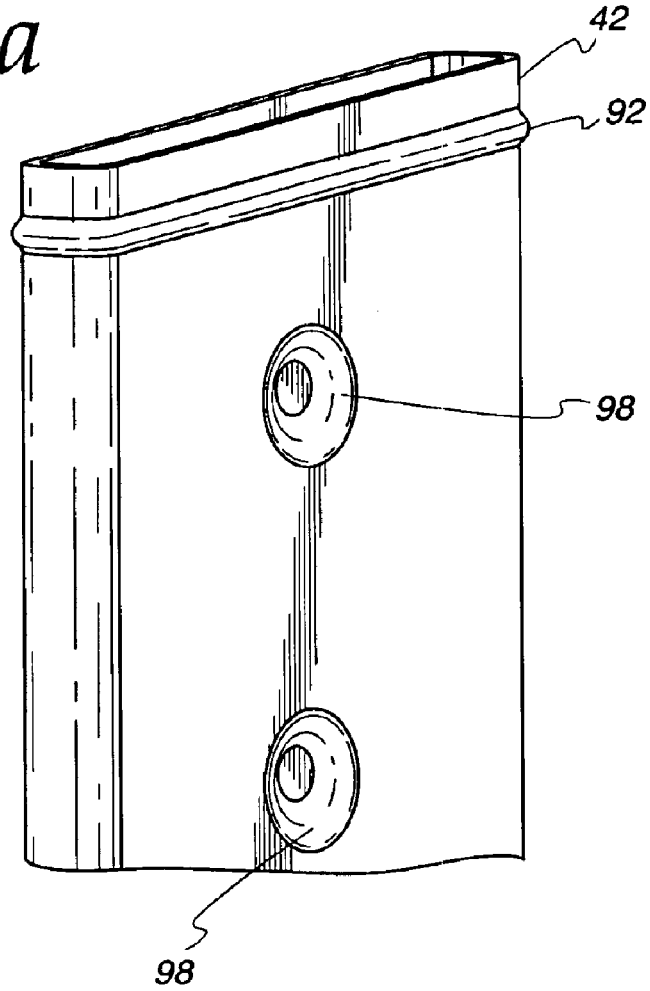
FIGS. 7*a–b* illustrate an end of still another multifunction flat tube which may be used in accordance with the present invention.
Figure 7B:
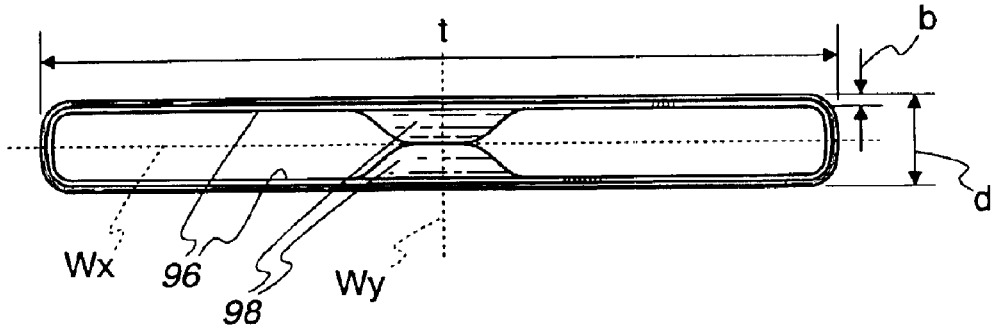

FIGS. 7*a*–*b* illustrate yet another multifunction flat tube 40*c* which may be advantageously used with the present invention. In this embodiment, the long side walls 96 of the tube 40*c* include inwardly directed protrusions 98 which are suitably connected to the opposite side wall 96 (e.g., by soldering to a similar protrusion 98).

Still other multifunction flat tube designs using these and/or other features could be advantageously used within the scope of the invention. For example, longitudinally extending inwardly directed protrusions could be soldered together (similarly to the longitudinally spaced protrusions 98 of the FIGS. 7*a*–*b* embodiment) so as to define separate parallel flow paths through such a tube.

It should thus be appreciated that radiators incorporating the present invention may benefit from one or more of the various benefits provided thereby. A filling function can be provided to assist in achieving proper operation of the radiator. Also, a single core design may be used for radiators with or without a filling function. Further, a stable core may be provided without significantly impacting the weight or size of the radiator, whereby the side plates required in the prior art may be omitted. Still further, the ability to assemble the multifunction flat tubes 40 together with the coolant flat tubes 30, without requiring assembly of such side plates, provides manufacturing advantages. Moreover, performance of the radiator may be improved by achieving a more uniform temperature distribution over the entire radiator core dues to the side regions of the radiator being heated more quickly as a result of the multifunction flat tubes.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

What is claimed is:

1. A radiator for a vehicle, comprising:

an inlet header;

an outlet header;

a soldered core with a core length "h" and a core depth "t", said core having a plurality of coolant flat tubes joining said inlet header and said outlet header, wherein said flat tubes extend generally vertically with said inlet header soldered to the upper ends of said flat tubes, and cooling fins on opposite sides of said coolant flat tubes;

a multifunction flat tube on one side of said core and having a greater section modulus (Wx, Wy) than said coolant flat tubes, said multifunction flat tube being soldered to adjacent cooling fins and said inlet and outlet headers whereby said multifunction flat tube carries coolant from said inlet header to said outlet header;

a first partition in said inlet header defining separated first and second inlet chambers, said first inlet chamber being above said multifunction flat tube and said second inlet chamber being above said coolant flat tubes whereby coolant in said multifunction flat tube is received from said first inlet chamber and coolant in said flat tubes is received from said second inlet chamber; and a filling line between a coolant fill supply and said first inlet chamber for adding coolant to said radiator.

2. The radiator of claim 1, further comprising:

a second multifunction flat tube on the opposite side of said core and soldered to adjacent cooling fins and said inlet and outlet headers whereby said second multifunction flat tube carries coolant from said inlet header to said outlet header, said second multifunction flat tube having a greater section modulus (Wx, Wy) than said coolant flat tubes;

a second partition in said inlet header defining a third inlet chamber separated from said second inlet chamber, said third inlet chamber being above said second multifunction flat tube whereby coolant in said second multifunction flat tube is received from said third inlet chamber; and said filling line also extends between the coolant fill supply and said third inlet chamber for adding coolant to said radiator.

3. The radiator of claim 1, wherein said radiator is a downdraft radiator with said inlet header on top and said outlet header on the bottom, and said inlet and outlet headers include a plurality of openings each of which receives an end of one of said coolant flat tubes, and an end opening receiving an end of said multifunction flat tube, said end opening being larger than each of said plurality of openings.

4. The radiator of claim 1, wherein said multifunction flat tube has substantially the same length "h" and depth "t" as said core.

5. The radiator of claim 1, wherein said multifunction flat tube is formed by one of soldering and welding.

6. The radiator of claim 1, wherein said multifunction flat tube includes walls extending the depth of said core, said tube walls being deformed along their length between said inlet and outlet headers to define separate coolant passages.

7. The radiator of claim 1, wherein said multifunction flat tube includes flat walls extending the depth of said core, and further comprising an insert between said flat walls of said multifunction flat tube, said insert defining coolant passages through said multifunction flat tube between said inlet and outlet headers.

8. The radiator of claim 1, wherein said multifunction flat tube includes flat walls extending the depth of said core with inward directed protrusions, said protrusions being connected to each other.

9. The radiator of claim 1, wherein the inner flow resistance of the multifunction flat tube is substantially smaller than the inner flow resistance of said coolant flat tubes.

10. The radiator of claim 1, wherein said multifunction flat tube has a wall thickness substantially greater than the wall thickness of said coolant flat tubes and a tube height substantially greater than the height of said coolant flat tubes.

11. The radiator of claim 10, wherein said multifunction flat tube wall thickness is at least two times the wall thickness of said coolant flat tubes.

12. The radiator of claim 11, wherein said multifunction flat tube wall thickness is at least about 1.0 mm.

13. The radiator of claim 10, wherein the height of said multifunction flat tube is at least two times the height of said coolant flat tubes.

14. The radiator of claim 13, wherein the height of said multifunction flat tube is at least about 10 mm.

15. The radiator of claim 1, wherein said filling line slopes down from the coolant fill supply to the first inlet chamber.

16. A radiator for a vehicle, comprising:

an inlet header;

an outlet header;

a soldered core having a plurality of coolant flat tubes extending generally vertically and joining said inlet header and said outlet header with upper ends of said coolant tubes soldered to said inlet header, and cooling fins on opposite sides of said coolant flat tubes;

a multifunction flat tube which is soldered to adjacent cooling fins on one side of said core and to said inlet and outlet headers whereby said multifunction flat tube carries coolant from said inlet header to said outlet header, and having an inner flow resistance which is substantially smaller than the inner flow resistance of said coolant flat tubes whereby more coolant flows through said multifunction flat tube than flows through an individual coolant flat tube per unit time to influence temperature distribution over the entire radiator;

a partition in said inlet header defining separate first and second inlet chambers above said multifunction flat tube and said coolant flat tubes, respectively whereby coolant in said multifunctional flat tube is received from said first inlet chamber and coolant in said flat tubes is received from said second inlet chamber; and a filling line between a coolant fill supply and said first inlet chamber for adding coolant to said radiator.

17. The radiator of claim 16, further comprising a second multifunction flat tube on the opposite side of said core and soldered to adjacent cooling fins and said inlet and outlet headers whereby said second multifunction flat tube carries coolant from said inlet header to said outlet header, said second multifunction flat tube having an inner flow resistance which is substantially smaller than the inner flow resistance of said coolant flat tubes whereby more coolant flows through said second multifunction flat tube than flows through an individual coolant flat tube per unit time to influence temperature distribution over the entire radiator a second partition in said inlet header defining a third inlet chamber separated from said second inlet chamber, said third inlet chamber being above said second multifunction flat tube whereby coolant in said second multifunction flat tube is received from said third inlet chamber; and said filling line also extends between the coolant fill supply and said third inlet chamber for adding coolant to said radiator.

18. The radiator of claim 16, wherein said radiator is a downdraft, radiator with said inlet header on top and said outlet header on the bottom, and said inlet and outlet headers include a plurality of openings each of which receives an end of one of said coolant flat tubes, and an end opening receiving an end of said multifunction flat tube, said end opening being larger than each of said plurality of openings.

* * * * *